US008205716B2

(12) United States Patent
Wirth

(10) Patent No.: US 8,205,716 B2
(45) Date of Patent: Jun. 26, 2012

(54) EXHAUST MUFFLER

(75) Inventor: Georg Wirth, Kirchheim/Teck (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 0 days.

(21) Appl. No.: 13/010,412

(22) Filed: Jan. 20, 2011

(65) Prior Publication Data

US 2011/0192676 A1 Aug. 11, 2011

(30) Foreign Application Priority Data

Feb. 5, 2010 (DE) ..... 10 2010 007 012

(51) Int. Cl.
*F01N 1/08* (2006.01)

(52) U.S. Cl. ..... 181/269; 181/212; 29/890.08

(58) Field of Classification Search ..... 181/269; 29/890.08

See application file for complete search history.

(56) References Cited

U.S. PATENT DOCUMENTS

| | | | | |
|---|---|---|---|---|
| 2,831,547 | A | 4/1958 | Willsea | |
| 3,941,206 | A | 3/1976 | Halter | |
| 4,076,099 | A | 2/1978 | Proksch | |
| 5,713,611 | A * | 2/1998 | Kurimoto et al. | 285/382.5 |
| 6,463,655 | B1 * | 10/2002 | Williams et al. | 29/890.08 |
| 2002/0144400 | A1 * | 10/2002 | Baldwin | 29/890.08 |
| 2004/0168320 | A1 * | 9/2004 | Sanderson | 29/890.08 |
| 2004/0191132 | A1 * | 9/2004 | DeSousa et al. | 422/179 |
| 2008/0196969 | A1 * | 8/2008 | Henke et al. | 181/212 |
| 2008/0216464 | A1 * | 9/2008 | Wirth | 60/282 |

FOREIGN PATENT DOCUMENTS

| | | | |
|---|---|---|---|
| EP | 1 967 709 | B1 | 9/2008 |
| WO | WO 2006/131165 | A1 | 12/2006 |
| WO | WO 2008/018821 | A1 | 2/2008 |

* cited by examiner

*Primary Examiner* — Forrest M Phillips
(74) *Attorney, Agent, or Firm* — McGlew and Tuttle, P.C.

(57) ABSTRACT

An exhaust muffler (1) for an exhaust system of an internal combustion engine, especially of a motor vehicle, includes two front-side end panels (2) facing away from each other, a circumferential jacket (3) closed in the circumferential direction, at least one exhaust muffler insert (4), with at least one inlet pipe (5) and with at least one outlet pipe (6). At least one of the pipes (5, 6) extends through the jacket (3) into the interior (8) of the exhaust muffler and is fastened to the jacket (3). Manufacture can be simplified if the pipe (5, 6) extending through the jacket (3) has a cone (10) at its inner end, if the exhaust muffler insert (4) has a countercone (11) and if the cone (10) meshes with the countercone (11).

20 Claims, 2 Drawing Sheets

EXHAUST MUFFLER

CROSS REFERENCE TO RELATED APPLICATIONS

This application claims the benefit of priority under 35 U.S.C. §119 of German Patent Application DE 10 2010 007 012.2 filed Feb. 5, 2010, the entire contents of which are incorporated herein by reference.

FIELD OF THE INVENTION

The present invention pertains to an exhaust muffler for an exhaust system of an internal combustion engine, especially of a motor vehicle with two front-side end panels, which face away from each other, with a circumferential jacket, which is closed in the circumferential direction, with at least one exhaust muffler insert and with at least one inlet pipe and with at least one outlet pipe. In addition, the present invention pertains to a corresponding manufacturing process.

BACKGROUND OF THE INVENTION

Exhaust mufflers are divided according to the manufacture of their circumferential jacket, which is closed in the circumferential direction, into two types of manufacture, namely, exhaust mufflers of the shell construction and exhaust mufflers of the winding construction. While two deep-drawn metal sheets are connected to one another at the edge in the shell construction, a metal sheet is wound around a core and closed in the winding construction. An exhaust muffler insert is subsequently pushed on the front side, i.e., axially into the wound jacket and two end panels are fastened or inserted on the front side at axial ends that are located mutually apart from each other and connected to the jacket, e.g., by tacking.

At least one pipe, especially an inlet pipe, is arranged laterally in a transversely mounted exhaust muffler, especially in a transversely mounted rear muffler, so that it extends through the jacket and into the interior of the exhaust muffler. This is problematic in connection with the winding construction, because this laterally arranged pipe can be mounted only after insertion of the exhaust muffler insert, since it is necessary for absorbing the forces occurring during the operation to support the pipe inserted through the jacket at both the jacket and the exhaust muffler insert located on the inside. However, this supporting at the exhaust muffler insert can be embodied with difficulty only in conjunction with the winding construction because of the reduced accessibility.

An exhaust muffler of the type mentioned in the introduction is known from WO 2006/131165 A1. It comprises two front-side end panels facing away from each other, a circumferential jacket, which is closed in the circumferential direction, at least one exhaust muffler insert, at least one inlet pipe and at least one outlet pipe. At least one of the pipes extends here through the jacket into the interior of the exhaust muffler. This pipe is fastened, in addition, to the jacket. This pipe is fastened, in addition, to the exhaust muffler insert in the prior-art exhaust muffler, namely, by mechanical forming. The pipe led laterally through the jacket is fastened to the exhaust muffler insert in the prior-art exhaust muffler, e.g., by inserting into the pipe an expansion tool, with which the pipe is widened in the area of a panel of the exhaust muffler insert, through which the pipe was inserted, such that the pipe with the panel is pressed in the radial direction in a positive-locking manner.

SUMMARY OF THE INVENTION

The present invention pertains to the object of providing an improved embodiment for an exhaust muffler of the type mentioned in the introduction, which embodiment is characterized especially by simplified manufacturability.

According to the present invention, an exhaust muffler is provided for an exhaust system of an internal combustion engine, especially of a motor vehicle, with two front-side end panels facing away from each other, with a circumferential jacket closed in the circumferential direction, with at least one exhaust muffler insert, with at least one inlet pipe and with at least one outlet pipe. At least one of the pipes extends through the jacket into the interior of the exhaust muffler and is fastened to the jacket. The pipe extending through the jacket has a cone (a curved or angled inner end connection surface) inner end and the exhaust muffler insert has a countercone (an angled or curved insert connection surface) and the cone meshes (engages) with the countercone.

The present invention is based on the general idea of equipping the pipe, which protrudes through the jacket into the interior of the exhaust muffler, at its inner end with a cone, which cooperates with an countercone formed at the exhaust muffler insert for supporting the pipe at the exhaust muffler insert in the mounted state. A positive-locking support is obtained between the pipe and the exhaust muffler insert radially and axially in relation to the axial direction of the pipe due to the cone meshing with the countercone. Both the cone and the countercone can be embodied in a comparatively simple manner. The positive-locking meshing of the cone in the countercone can likewise be brought about in a simple manner during mounting. Sufficient support is obtained in the mounted state for the laterally arranged pipe, namely, at the jacket, on the one hand, and, on the other hand, also at the exhaust muffler insert via the cone cooperating with the countercone. Sufficient stability is thus obtained for the laterally arranged pipe along with low-cost manufacturability.

Corresponding to an advantageous embodiment, the pipe extending into the interior of the exhaust muffler may be arranged such that it is supported at the exhaust muffler insert under an axial prestress via the cone meshing with the countercone. Any clearance between the cone and the countercone is eliminated by the prestress, as a result of which relative movements between the pipe and the exhaust muffler insert can be avoided as well. The supporting action for the respective pipe is improved hereby.

According to a special embodiment, the axial prestress, with which the pipe is supported at the exhaust muffler insert, is selected specifically to be such that a minimum axial prestress is preserved over the entire expectable thermal operating range of the exhaust muffler. It is possible as a result to take into account, in particular, thermal expansion effects, so that sufficient stability can be guaranteed for the exhaust muffler in all operating states.

The cone may have a conical segment-shaped or spherical segment-shaped design at least on its outer contour. Fitting hereto, the countercone may have a conical segment-shaped or spherical segment-shaped or funnel-shaped design at least on its inner contour. If the cone has a spherical segment-shaped outer cone, positional tolerances, which may occur in connection with the manufacture, can be compensated in a simple manner, because the pipe does not now have to be mounted exactly coaxially with the countercone of the exhaust muffler insert to achieve the desired supporting action.

Other important features and advantages of the present invention appear from the subclaims, from the drawings and from the corresponding description of the figures on the basis of the drawings.

It is apparent that the above-mentioned features, which will also be explained below, can be applied not only in the particular combination indicated, but in other combinations or alone as well, without going beyond the scope of the present invention.

Preferred embodiments of the present invention are shown in the drawings and will be explained in more detail in the following description, where identical reference numbers designate identical or similar or functionally similar components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
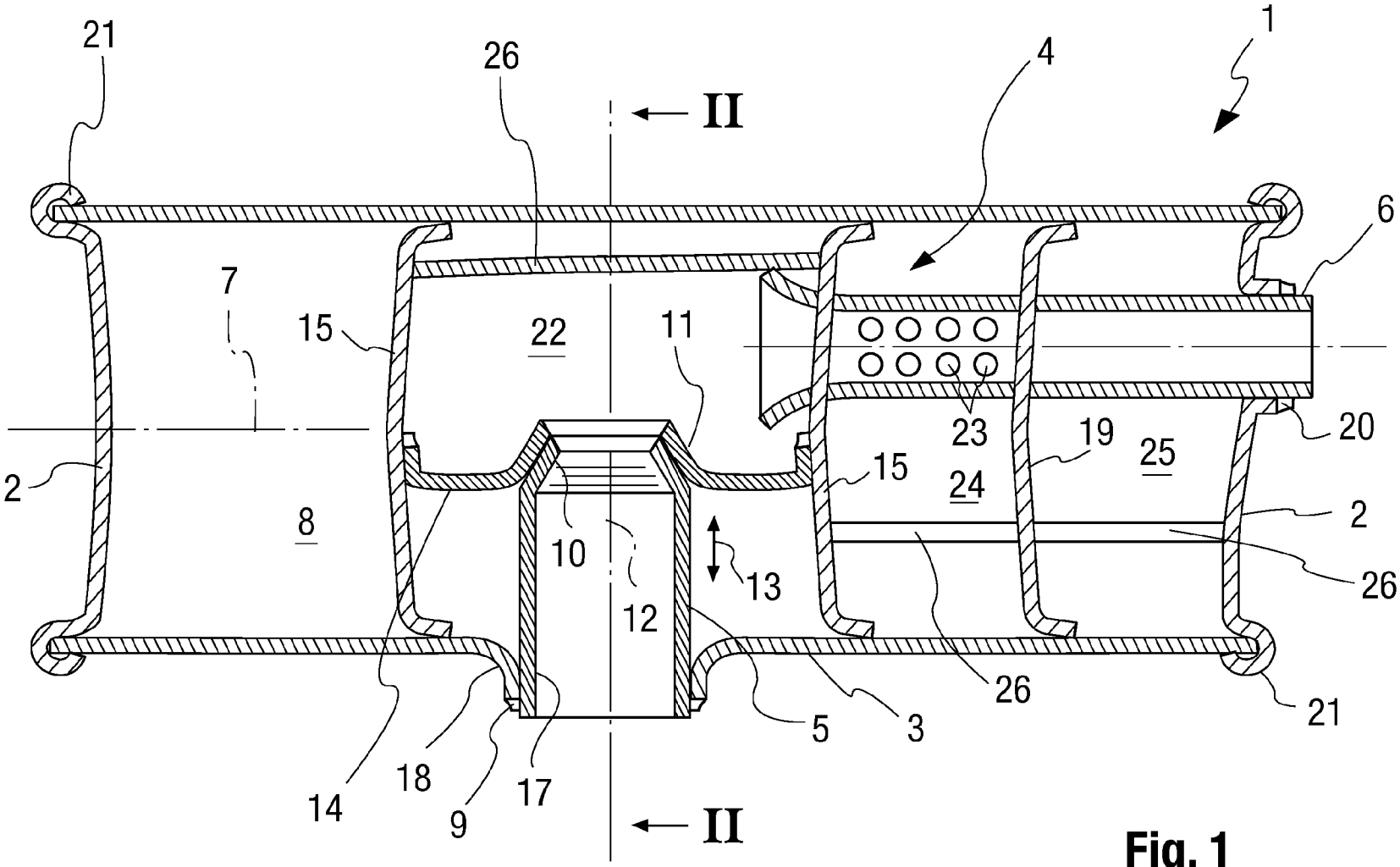
FIG. 1 is a greatly simplified longitudinal sectional view through an exhaust muffler according to the invention.
Figure 2:
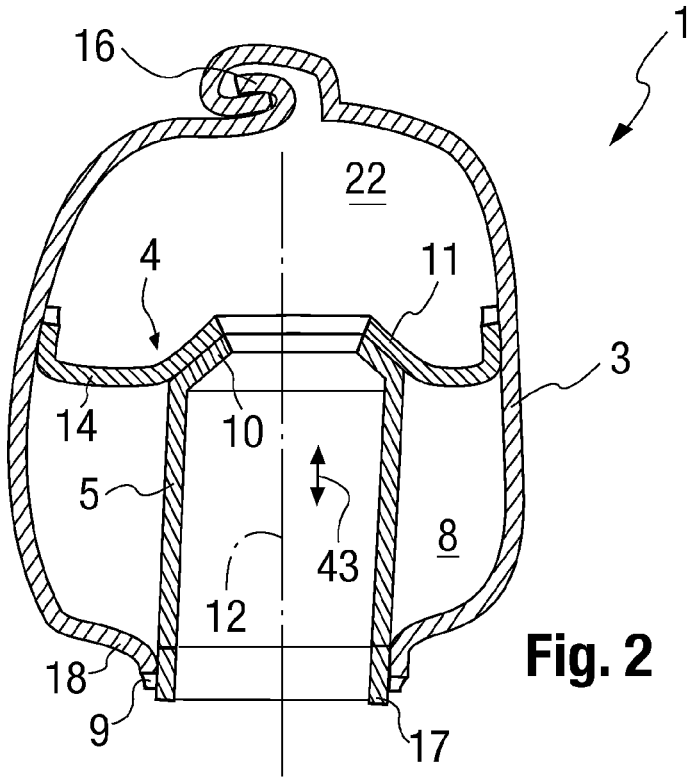
FIG. 2 is a cross sectional view of the exhaust muffler corresponding to section lines II from FIG. 1.

Referring to the drawings in particular, corresponding to FIGS. 1 and 2, an exhaust muffler 1 comprises two front-side end panels 2, which face away from one another, a circumferential jacket 3, which is closed in the circumferential direction, at least one exhaust muffler insert 4, at least one inlet pipe 5 and at least one outlet pipe 6.

The exhaust muffler 1 is intended for installation in an exhaust system, not shown, of an internal combustion engine and may be used especially in a motor vehicle. Exhaust muffler 1 is preferably a rear muffler, which is the exhaust muffler through which the exhaust gas flows last within the exhaust system in respect to the direction of flow of the exhaust gas before the exhaust gas reaches the respective tail pipe of the exhaust system, which tail pipe has the opening of the exhaust system to the environment. The exhaust muffler is especially advantageously an exhaust muffler that is arranged transversely in the mounted state. In the transversely mounted exhaust muffler 1, an axial direction 7 of the exhaust muffler 1 extends essentially in parallel to a horizontal transverse direction of the vehicle. To make it possible to install the exhaust muffler 1 transversely in the vehicle in a simpler manner, at least one of the pipes, i.e., at least an inlet pipe 5 and/or an outlet pipe 6, extends through the jacket 3 into the interior 8 of the exhaust muffler. Exactly one pipe, namely, the inlet pipe 5, extends through the jacket 3 in the example being shown. Only a single inlet pipe 5 is also preferably provided. Contrary hereto, more than one outlet pipe 5 may be provided as well. Even though it is always only the inlet pipe 5 that passes laterally through the jacket 3 in the following description, the outlet pipe 6 may also be the pipe 5, 6 passing laterally through the jacket 3 in another embodiment with opposite direction of flow. An embodiment is also possible in which both the at least one inlet pipe 5 and the at least one outlet pipe 6 are arranged laterally and pass through the jacket 3. All feeding and discharging pipes 5, 6 may optionally also be connected laterally to the jacket 3.

The inlet pipe 5 is fastened to the jacket 3. At least one welded connection 9, with which the inlet pipe 5 is fastened to the jacket 3, is provided in the example. This may be, e.g., a circumferential weld seam closed in a ring-shaped pattern, as a result of which a gastight connection is created at the same time. It is also possible as an alternative, e.g., during the manufacture of the exhaust muffler 1, to fasten the inlet pipe 5 to the jacket 3 by means of at least one weld point or tack-welding. A corresponding feed pipe can then be connected to the inlet pipe 5 when installing the exhaust muffler 1 into an exhaust system. A circumferential weld seam can then be prepared when fastening the feed pipe. A three-metal sheet seam, which simultaneously connects three metal sheets, i.e., the inlet pipe 5, jacket 3 and feed pipe to one another here, is now preferably prepared.

The inlet pipe 5 passes for this purpose through an opening 17 prepared laterally in the jacket 3. The respective welded connection 9 may be prepared at a front-side end of a collar 18, which is flared towards the outside, and which surrounds the opening 17.

At its inner end, the inlet pipe 5 has a cone 10, which meshes with a countercone 11, which has a shape that is fitting or complementary thereto, and which is provided at the exhaust muffler insert 4. The cone 10 is a curved or angled inner end connection surface. The countercone 11 is an angled or curved insert connection surface. The inlet pipe 5 is radially and axially supported in respect to its longitudinal axis 12 at the exhaust muffler insert 4 due to this positive-locking meshing of the cone 10 with the countercone 11 having a suitable shape therefor. The inlet pipe 5 is thus supported, on the one hand, at the jacket 3 and, on the other hand, at a spaced location therefrom, at the exhaust muffler insert 4 via the cone 10 meshing with the countercone 11. The inlet pipe 5 can hereby absorb torques and readily support the forces occurring during the operation.

It is especially advantageous if the inlet pipe 5 is arranged such that it is supported at the exhaust muffler insert 4 under an axial prestress relative to the longitudinal axis 12 of the pipe. This axial prestress is indicated in FIG. 1 by a double arrow and is designated by 13. The axial prestress 13 acts between the exhaust muffler insert 4 and the jacket 3 and is transmitted via the inlet pipe 5 between the jacket 3 and the exhaust muffler insert 4. In other words, the inlet pipe 5 meshes with its cone 10 with the countercone 11 under the axial prestress 13.

According to a preferred embodiment the axial prestress 13 is not selected as desired but has a predetermined value. In particular, the axial prestress 13 may be specifically selected to be so high that a minimum axial prestress is guaranteed for the entire temperature range to be expected during the operation of the exhaust muffler. The thermal operating range may range, e.g., from −40° C. to +500° C. during the use of the vehicle if the exhaust muffler is a rear muffler.

Cone 10 is preferably made integrally in one piece with the inlet pipe 5. For example, the inner end of the inlet pipe 5 is formed to prepare the cone 10. However, a built-up variant is also possible, in principle.

The countercone 11 is formed at a bracket 14 of the exhaust muffler insert 4. This bracket 14 is fastened here to two intermediate panels 15 of the exhaust muffler insert, which are arranged each between the two end panels 2.

The countercone 11 is preferably made integrally in one piece with the bracket 14. For example, bracket 14 is a shaped metal sheet part, which is manufactured from a flat metal sheet blank by forming. A built-up embodiment is possible as well. Bracket 14 is preferably configured such that it has spring elasticity. This spring elasticity simplifies the generation of the axial prestress 13. Bracket 14 is clamped during mounting quasi like a spring in order to generate the prestress 13. To make it possible to generate a comparatively high prestress, bracket 14 is provided with a comparatively high spring rate. This can be achieved, e.g., by the bracket 14 being designed, as in the example being shown, as a panel, which extends at right angles to the longitudinal axis 12 of the pipe.

Jacket 3 is formed by winding a metal sheet part. This is correspondingly an exhaust muffler 1 manufactured according to the winding construction. For example, jacket 3 may have, according to FIG. 2, a longitudinal fold 16, which extends in parallel to the longitudinal axis 7 of the exhaust muffler. The longitudinal fold 16 is preferably positioned on a side facing away from the inlet pipe 5.

At least one of the end panels 2, in this case the end panel 2 shown on the right in FIG. 1, may be a part of the exhaust muffler insert 4. Corresponding to the winding construction of the exhaust muffler 1, the exhaust muffler insert 4 is inserted into jacket 3 axially, i.e., in parallel to the longitudinal axis 7 of the exhaust muffler and consequently on the front side. Provisions may be preferably made for the outer dimension of the insert 4 and the inner dimension of the jacket 3 to be coordinated with one another such that the exhaust muffler insert 4 is in contact with or is held by the jacket 3 under a radial prestress relative to the longitudinal axis 7 of the exhaust muffler.

The at least one outlet pipe 6 extends through one of the end panels 2, here through the end panel 2 shown on the right in FIG. 1, which belongs to the exhaust muffler insert 4 in the example. In addition, the outlet pipe 6 extends in the example through one of the intermediate panels 15, which are provided for positioning the bracket 14, as well as through another intermediate panel 19, which is arranged between the aforementioned intermediate panel 15 and the corresponding end panel 2. The outlet pipe 6 is fastened at least to the end panel 2, e.g., by means of a welded connection 20, in order to achieve a gastight connection here as well. The end panels 2 are fastened to or are inserted into the jacket 3 axially and are firmly connected to the jacket 3, e.g., by means of a circumferential tacked connection 21.

Corresponding to FIGS. 1 and 2, cone 10 may be supported at the countercone 11 in the circumferential direction of the inlet pipe 5 in an annularly closed manner. As a result, radial supporting of the inlet pipe 5 at the exhaust muffler insert 4 is possible in each direction.

As can be determined from FIGS. 1 and 2, cone 10 and countercone 11 are arranged at spaced locations from the jacket 3. This is achieved by positioning the bracket 14 at a spaced location from the jacket 3 in the longitudinal axis 12 of the pipe in relation to the jacket 3. In particular, bracket 14 is arranged approximately centrally in the interior 8 of the exhaust muffler, namely, relative to the longitudinal axis 12 of the pipe.

The inlet pipe 5 is axially open, so that the exhaust gas can flow through the cone 10 and through the countercone 11, i.e., through the bracket 14. The inlet pipe 5 is correspondingly connected fluidically with the interior 8 of the exhaust muffler through the cone 10 meshing with the countercone 11. The inlet pipe 5 opens in the example through the bracket 14 into a space 22, which is formed in the interior 8 of the exhaust muffler by the exhaust muffler insert 4. This space 22 is defined laterally by the partitions 15, bracket 14 and by a section of the jacket 3. The side walls, partitions 15 and/or bracket 14 may be made permeable to gas or sound, for example, by means of openings or by means of a perforation. The outlet pipe 6 begins in the example being shown in said space 22 and leads out of the exhaust muffler 1. The outlet pipe 6 may have a perforation 23 in order to communicate with a space 24, which is formed between the partitions 15, 19. Partition 19 may also be made permeable to gas or sound in order to enlarge the space 24 up to the end panel 2, so that a space 25, which is formed between the intermediate panel 19 and the end panel 2, can also be used as an adsorption chamber.

The exhaust muffler insert 4 being shown here is equipped, in addition, with support elements 26, which support the individual panels 15, 19, 2 of the exhaust muffler insert 4 in the axial direction 7 at each other. The axial insertion of the exhaust muffler insert 4 into the jacket 3 under axial prestress is facilitated hereby, because the panels 15, 19, 2 are prevented from tilting.

Corresponding to FIGS. 3 through 6, different configurations or embodiments can be embodied for the cone 10 and countercone 11. For example, cone 10 according to FIG. 3 may have a conical segment-shaped outer contour 27. According to FIGS. 4 through 6, the outer contour 27 of cone 10 may also be spherical segment-shaped. Other forms are also conceivable for the outer contour 27.

Figure 3:
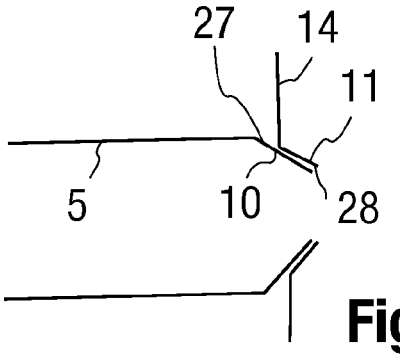
FIG. 3 is a longitudinal sectional view of the exhaust muffler in the area of a laterally arranged pipe in one of different embodiments.

According to FIG. 3, the countercone 11 may have a conical segment-shaped inner contour 28. An especially intensive flat support of the inlet pipe 5 at bracket 14, which support is closed in an annular pattern, is obtained now in case of mutually coordinated angles and coaxial alignment of cone 10 and countercone 11.

Figure 5:
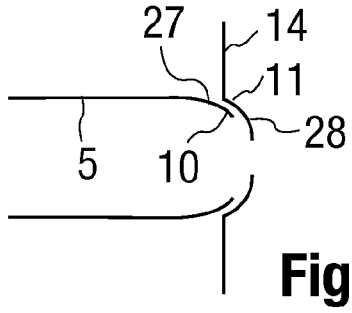
FIG. 5 is a longitudinal sectional view of the exhaust muffler in the area of a laterally arranged pipe in another of different embodiments.
Figure 6:
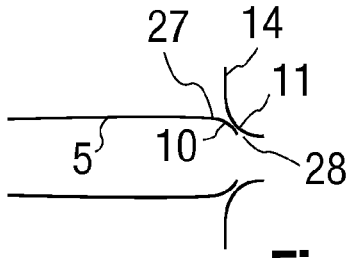
FIG. 6 is a longitudinal sectional view of the exhaust muffler in the area of a laterally arranged pipe in another of different embodiments.

However, the countercone 11 may also have a spherical segment-shaped inner contour 28 according to FIG. 5 or a funnel-shaped inner contour 28 according to FIG. 6. The funnel-shaped inner contour 28 according to FIG. 6 is characterized, contrary to the spherical segment-shaped inner contour 28 from FIG. 5 and the conical segment-shaped inner contour 28 in FIGS. 3 and 4, in that the inner contour has a curved profile, which is convex towards the cone 10.

Figure 4:
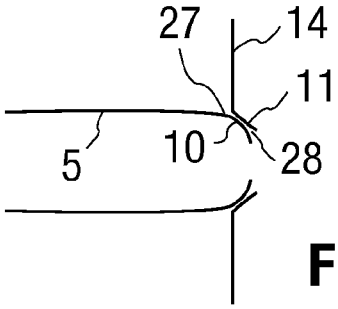
FIG. 4 is a longitudinal sectional view of the exhaust muffler in the area of a laterally arranged pipe in another of different embodiments.

In the embodiments according to FIGS. 4 through 6, a cone 10 with a spherical segment-shaped outer contour 27 meets a conical segment-shaped inner contour 28 (FIG. 4) or a spherical segment-shaped inner contour 28 (FIG. 5) or a funnel-shaped inner contour 28 (FIG. 6) of the countercone 11. A linear contact, which is closed in the circumferential direction, is obtained between cone 10 and countercone 11 in these embodiments even if cone 10 and countercone 11 are not aligned exactly coaxially with one another. Thus, these embodiments make it possible to compensate manufacturing tolerances. The embodiment according to FIG. 4, in which a spherical segment-shaped outer contour of cone 10 cooperates with a conical segment-shaped inner contour 28 of the countercone 11, is preferred here. This embodiment can be embodied at a comparatively low cost.

The exhaust muffler 1 being presented here can be manufactured preferably as follows: The respective exhaust muffler insert 4 is first pushed into the jacket 3 on the front side, i.e., in parallel to the longitudinal axis 7 of the exhaust muffler. The inlet pipe 5 is then inserted laterally into the opening 17 of jacket 3, namely, to the extent that cone 10 will mesh with countercone 11. The inlet pipe 5 is then fastened to the jacket 3.

Before fastening the inlet pipe 5 to the jacket 3, the inlet pipe 5 is preferably inserted through the opening 17 into the interior 8 of the exhaust muffler to the extent that the inlet pipe 5 is supported at the exhaust muffler insert 4 via the cone 10 meshing with the countercone 11 with the axial prestress 13, especially with the predetermined axial prestress 13. The fastening of the inlet pipe 5 to the jacket 3, i.e., especially the preparation of the welded connection 9, will then be performed while the axial prestress 13 is maintained, i.e., while the inlet pipe 5 is supported at the exhaust muffler insert 4 in the axially prestressed state. As a result, the prestress 13 applied before, especially in a specific manner, is preserved.

While specific embodiments of the invention have been described in detail to illustrate the application of the principles of the invention, it will be understood that the invention may be embodied otherwise without departing from such principles.

What is claimed is:

1. An exhaust muffler for an exhaust system of an internal combustion engine, the exhaust muffler comprising:

Two front-side end panels, which face away from each other;

A circumferential jacket, which is closed in a circumferential direction and cooperates with the two front-side end panels to form an interior of the exhaust muffler;

An exhaust muffler insert;

An inlet pipe; and

An outlet pipe, at least one of the inlet pipe and the outlet pipe being a pipe extending through the jacket into the interior of the exhaust muffler ad being fastened to the jacket and having an inner end with a cone, wherein the exhaust muffler insert has a counter cone and the cone engages with the countercone, the pipe extending through the jacket is arranged such that it is supported at the exhaust muffler insert under axial prestress via the cone engaging with the countercone.

2. An exhaust muffler in accordance with claim 1, wherein the axial prestress is a predetermined axial prestress selected such that a minimum axial prestress is preserved over an entire expectable thermal operating range of the exhaust muffler.

3. An exhaust muffler in accordance with claim 1, wherein:

the cone has a conical segment-shaped or spherical segment-shaped outer contour;

the countercone has a conical segment-shaped or spherical segment-shaped or funnel-shaped inner contour; and the countercone has a shape complementary to that of the cone.

4. An exhaust muffler in accordance with claim 1, further comprising:

two intermediate panels;

a bracket fastened to the two intermediate panels and arranged between the end panels, wherein:

the cone is made integrally in one piece with the pipe extending through the jacket;

the countercone is formed at the bracket, which is fastened to two intermediate panels arranged between the end panels; and the countercone is made integrally in one piece with the bracket.

5. An exhaust muffler in accordance with claim 4, wherein at least one of the following:

the bracket is at least one of embodied and arranged such that it has spring elasticity in the area of the countercone in parallel to a longitudinal axis of the pipe extending through the jacket having the cone; and the bracket is designed as a panel extending at right angles to the longitudinal axis of the pipe extending through the jacket having the cone.

6. An exhaust muffler in accordance with claim 1, wherein at least one of the following:

the jacket is formed by winding a metal sheet part; and the jacket has a longitudinal fold, which is located on a side facing away from the pipe passing through the jacket; and at least one of the end panels forms a part of the exhaust muffler insert; and the exhaust muffler insert is inserted into the jacket on the front side, and the jacket is in contact with the exhaust muffler insert in a prestressed state; and the other of the inlet pipe and the outlet pipe extending through one of the end panels and being fastened to the end panel.

7. An exhaust muffler in accordance with claim 1, wherein at least one of the following:

the cone is supported at the countercone such that the cone is closed in a ring-shaped pattern in the circumferential direction of the pipe extending through the jacket; and the cone and the countercone are located at spaced locations from the jacket; and the pipe extending through the jacket is fluidically connected to the interior of the exhaust muffler to a space formed by the exhaust muffler insert in the interior of the exhaust muffler, through the cone and through the countercone.

8. An exhaust muffler in accordance with claim 1, wherein:

said cone and said counter cone are in only surface contact with each other.

9. A process for manufacturing an exhaust muffler for an exhaust system of an internal combustion engine, the process comprising the steps of:

Providing two front-side end panels, a circumferential jacket closed in a circumferential direction, an exhaust muffler insert, an inlet pipe and an outlet pipe;

Pushing the exhaust muffler inset into the circumferential jacket;

Inserting one of the inlet pipe and the outlet pipe laterally into an opening of the circumferential jacket to the extent that a cone at a preceding end of the inserted pipe engages with a counter cone formed at the exhaust muffler insert, the inserted pipe being inserted to the extent that the inserted pipe is supported at the exhaust muffler insert with an axial prestress via the cone engaging with the countercone; and fastening the inserted pipe to the jacket, the inserted pipe being fastened to the jacket while the inserted pipe is supported at the exhaust muffler insert in an axially prestressed state.

10. A process in accordance with claim 9, wherein:

said cone and said counter cone are only brought into surface contact with each other.

11. An exhaust muffler comprising:

a first end panel;

a second end panel;

a circumferential jacket closed in a circumferential direction and cooperating with said first end panel and said second end panel to form an interior of the exhaust muffler, said jacket defining a jacket opening;

an insert disposed in said interior of the exhaust muffler, said insert defining an insert opening, said insert having an insert connection surface arranged around said insert opening, said insert connection surface having a conical shape;

a lateral pipe extending through said jacket opening in said jacket and into said interior of the exhaust muffler, said lateral pipe being fastened to said jacket at said jacket opening, said lateral pipe having an end defining a pipe opening, said lateral pipe having a pipe connection surface with a conical shape around said pipe opening, said pipe connection surface engaging with said insert connection surface, said pipe connection surface being in only surface contact with said insert connection surface.

12. An exhaust muffler in accordance with claim 11, wherein:

said lateral pipe is arranged and fastened to said jacket to apply a biasing force from said pipe connection surface to said insert connection surface, said biasing force in combination with said conical shapes of said connection surfaces holding said insert fixed in said interior of the exhaust muffler relative to said jacket.

13. An exhaust muffler in accordance with claim 11, wherein:

said conical shape of said connection surfaces have shapes blocking said insert pipe from completely passing through said insert opening in a direction radially inward of said jacket;

said surface contact between said connection surfaces allows radially outward movement of said lateral pipe with respect to said insert.

14. An exhaust muffler in accordance with claim 12, wherein the pipe extending through the jacket is arranged such that it is supported at the insert under axial prestress via the pipe connection surface engaging with the insert connection surface.

15. An exhaust muffler in accordance with claim 12, wherein:

the pipe connection surface has a conical segment-shaped or spherical segment-shaped outer contour;

the insert connection surface has a conical segment-shaped or spherical segment-shaped or funnel-shaped inner contour; and the insert connection surface has a shape complementary to that of the pipe connection surface.

16. An exhaust muffler in accordance with claim 12, wherein:

the insert comprises two intermediate panels and a bracket fastened to the two intermediate panels and arranged between the end panels;

the pipe connection surface is made integrally in one piece with the pipe extending through the jacket;

the insert connection surface is formed at the bracket, which is fastened to the two intermediate panels arranged between the end panels; and the insert connection surface is made integrally in one piece with the bracket.

17. An exhaust muffler in accordance with claim 16, wherein the bracket is at least one of embodied and arranged such that it has spring elasticity in an area of the insert connection surface in parallel to a longitudinal axis of the pipe extending through the jacket having the pipe connection surface; and the bracket is designed as a panel extending at right angles to the longitudinal axis of the pipe extending through the jacket having the pipe connection surface.

18. An exhaust muffler in accordance with claim 12, wherein at least one of the following:

the pipe connection surface is supported at the insert connection surface such that the pipe connection surface is closed in a ring-shaped pattern in a circumferential direction of the pipe extending through the jacket; and the pipe connection surface and the insert connection surface are located at spaced locations from the jacket; and the pipe extending through the jacket is fluidically connected to the interior of the to a space formed by the insert in the interior of the exhaust muffler, through the pipe connection surface and through the insert connection surface.

19. An exhaust muffler for an exhaust system of an internal combustion engine, the exhaust muffler comprising:

Two front-side end panels, which face away from each other;

A circumferential jacket, which is closed in a circumferential direction and cooperates with the two front-side end panels to form an interior of the exhaust muffler;

An exhaust muffler insert;

An inlet pipe; and

An outlet pipe, at least one of the inlet pipe and the outlet pipe being a pipe extending through the jacket into the interior of the exhaust muffler and being fastened to the jacket and having an inner end with a cone, wherein the exhaust muffler insert has a countercone and the cone engages with the counter cone, said cone and said counter cone being only in surface contact with each other.

20. A process for manufacturing an exhaust muffler for an exhaust system of an internal combustion engine, the process comprising the steps of:

Providing two front-side end panels, a circumferential jacket closed in a circumferential direction, an exhaust muffler insert, an inlet pipe and an outlet pipe;

Pushing the exhaust muffler insert into the circumferential jacket;

Inserting one of the inlet pipe and the outlet pipe laterally into an opening of the circumferential jacket to the extent that a cone at a preceding end of the inserted pipe engages with a counter cone formed at the exhaust muffler insert, said cone and said countercone being only brought into surface contact with each other; and Fastening the inserted pipe to the jacket.

* * * * *